United States Patent [19]

Oldham

[11] Patent Number: 4,649,677

[45] Date of Patent: Mar. 17, 1987

[54] BUILDING CONSTRUCTION AND METHOD

[76] Inventor: Robert W. Oldham, P.O. Box 10922, Midwest City, Okla. 73140

[21] Appl. No.: 668,935

[22] Filed: Nov. 7, 1984

[51] Int. Cl.[4] ..... E04B 2/58

[52] U.S. Cl. ..... 52/90; 52/294; 52/583; 52/779; 52/742; 52/747

[58] Field of Search ..... 52/309.16, DIG. 9, 583, 52/587, 477, 741, 742, 747, 90, 93, 655, 648, 250, 779, 294, 292; 114/69

[56] References Cited

U.S. PATENT DOCUMENTS

| | | | |
|---|---|---|---|
| 860,682 | 7/1907 | Marshall | 52/90 |
| 1,303,022 | 5/1919 | Brown | 52/587 |
| 2,001,215 | 5/1935 | Ruppel | 52/93 |
| 2,154,619 | 4/1939 | Hurley | 52/587 |
| 2,577,323 | 12/1951 | Goenner | 52/583 |
| 3,171,772 | 3/1965 | Lomar | 52/309.16 |
| 3,857,215 | 12/1974 | Moore | 52/DIG. 9 |
| 3,883,911 | 5/1975 | Moore | 114/69 |
| 3,982,362 | 9/1976 | Moore | 52/DIG. 9 |
| 4,084,363 | 4/1978 | Moore | 52/DIG. 9 |

*Primary Examiner*—John E. Murtagh

*Attorney, Agent, or Firm*—Robbins & Laramie

[57] ABSTRACT

Home structure utilizing a cage-like black iron type framework embedded in a concrete floor slab and closed in by lightweight, insulating preformed block panels and boards that are welded to the framework in a high-strength unitary structure.

18 Claims, 11 Drawing Figures

FIG 1
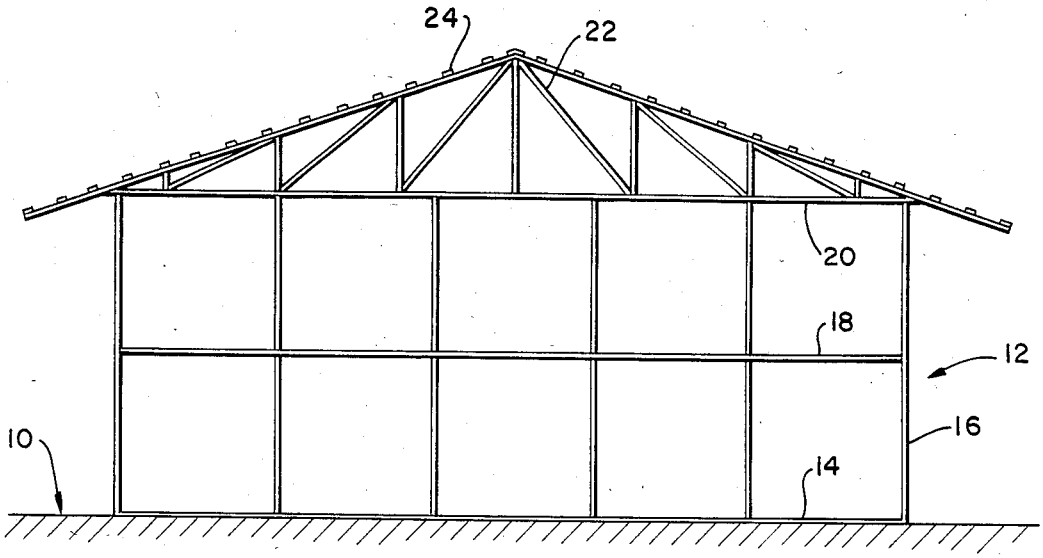
FIG 2
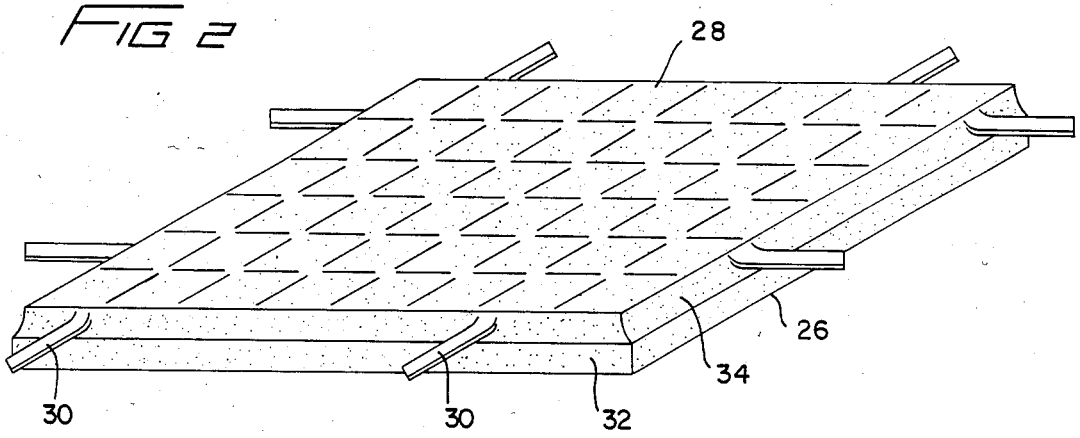
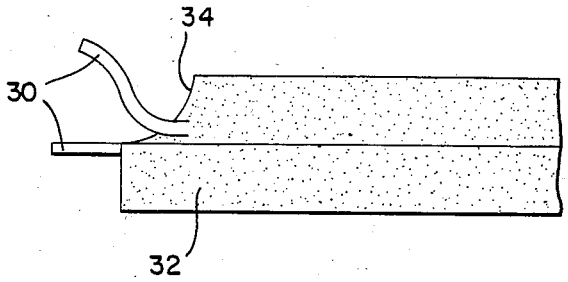
FIG 3

FIG 4
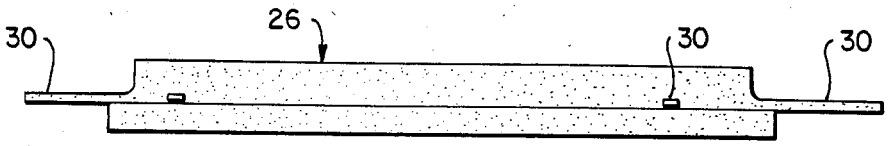
FIG 5
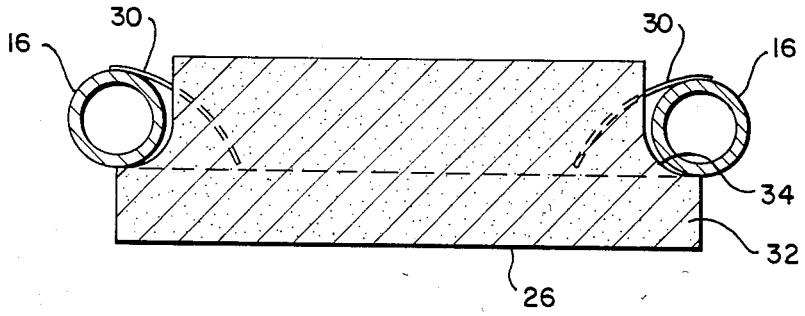
FIG 6
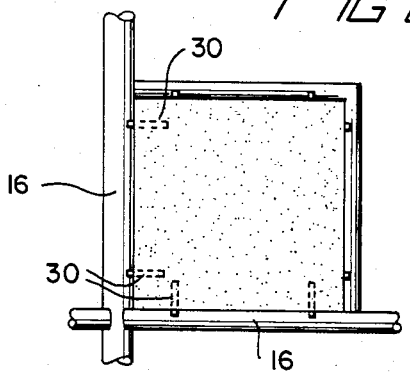
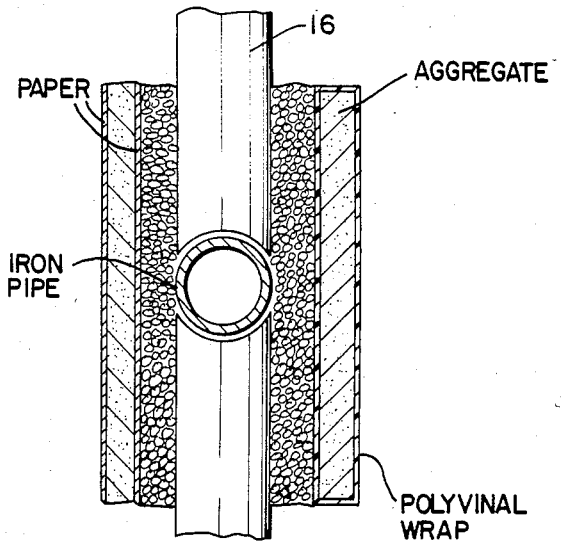
FIG 7
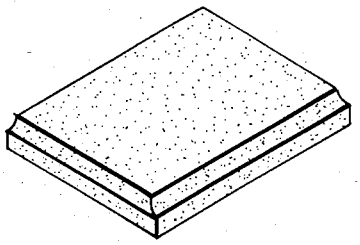
FIG 8

BUILDING CONSTRUCTION AND METHOD

RELATED APPLICATIONS

Some of the components that are useful in the building construction technique that is described in this application are in turn described in copending applications. Thus, the blocks or block panels that are shown in the drawings and described in the specification may be made in accordance with the teachings of Ser. No. 668,934, filed Nov. 7, 1984 now abandoned. The board or board panels and the process of making them are described in Ser. No. 668,908, filed Nov. 7, 1984 now abandoned. Both of these applications were filed in the name of the present applicant.

BACKGROUND OF THE INVENTION

This invention relates to a new technique for constructing buildings, especially homes useful for residences.

SUMMARY OF THE INVENTION

A building that is constructed in accordance with this invention is formed first with a cage-like framework that is fabricated from black iron pipe. This framework has bottom transverse pipe members engaged on the surface of the selected site and supporting the framework. The framework is also formed with upright pipe members and with other pipe members which, with the bottom transverse pipe members, are interposed between the upright pipe members to form the framework. A metal roof truss is seated on the framework and is part thereof. The pipe members and the truss are united to each other in a unitary structure, preferably by welding them together.

The upright pipe members and the transverse pipe members of the framework are disposed so as to provide a plurality of wall and ceiling openings of predetermined and preferably uniform size. Block panels are secured in these wall openings, and nest snugly therein. Each block panel has a peripheral flange that extends about underlying parts of the framework, about the opening in which that panel is seated. The block panels are each proportioned so that the confronting flanges of adjacent panels are in abutting engagement with each other. The panels thus form a generally continuous external surface for the framework, where the panels have been inserted in the wall openings. In addition, board panels are disposed over the roof truss to form a roof to cover the building.

To construct a building in accordance with one embodiment of the invention, the cage-like framework is erected on the selected site, using black iron or steel pipe. The framework is made from bottom pipe members that engage on the site surface to support the framework, and from upright and other transverse pipe members which, with the bottom transverse pipe members, are interposed between the upright pipe members to form the framework. A metal roof truss is seated on top of the framework. The pipes and truss are united to each other, preferably by welding them together.

In erecting the framework, care is taken to space the upright and transverse pipes in such a way as to provide wall and ceiling openings in the framework of a predetermined and preferably a uniform size. The process then involves securing, in these openings, preformed block panels that nest snugly within the openings. These panels are formed with peripheral flanges, and they are seated in the openings of the framework with the flanges extending about underlying pipe members of the framework. These flanges are proportioned so that the confronting flanges of adjacent panels abut each other.

Another important step in the process of constructing the building is that of pouring concrete on the site surface to form a floor for the building, with the concrete slab enclosing the bottom pipe members of the framework within the slab.

BRIEF DESCRIPTION OF THE DRAWINGS

FIG. 1 is a side elevation view showing one end of a cage-like framework for a building that is in accordance with one embodiment of the invention;

FIG. 2 is a perspective view, on an enlarged scale relative to FIG. 1, of a block panel that is constructed in accordance with a preferred embodiment of the invention, showing in dashed lines a reinforcing mesh that is embedded within the panel, and showing two straps projecting from each lateral side of the panel for securing the panel to the framework, preferably by welding;

FIG. 3 is a fragmentary side elevation, on an enlarged scale relative to FIG. 2, of one corner of the block panel shown in FIG. 2, showing the nearer of the two straps bent into the position that it preferably should occupy when being engaged against a pipe member of the framework before it is welded to that pipe member;

FIG. 4 is a side elevation, on a reduced scale, of the block panel, showing the fastening straps extending laterally straight outward from the sides of the panel;

FIG. 5 is a section, taken on a horizontal plane, showing a block panel nested within a wall opening in the framework, showing the straps welded to the pipes to hold the panel securely in place and make the structure unitary;

FIG. 6 is a fragmentary schematic view, on a reduced scale and in side elevation, showing a block panel inserted in one of the wall openings in the framework, showing four of the strap ends welded in place, and the other four strap ends welded in place, but in addition showing the parts of those straps that are within the block panel in dotted lines;

FIG. 7 is a fragmentary section, in a vertical plane, of a completely finished wall structure in accordance with one preferred embodiment of the invention, showing on the right side of FIG. 7 a board panel having an exterior finish, and on the left side of FIG. 7 a gypsum board panel having an interior finish, both of these panels being mounted on a pair of the adjacent block panels that are inserted in openings in the wall, respectively;

FIG. 8 is a perspective view of a preformed panel in accordance with another embodiment of the invention;

DESCRIPTION OF THE PREFERRED EMBODIMENT

Figure 10:
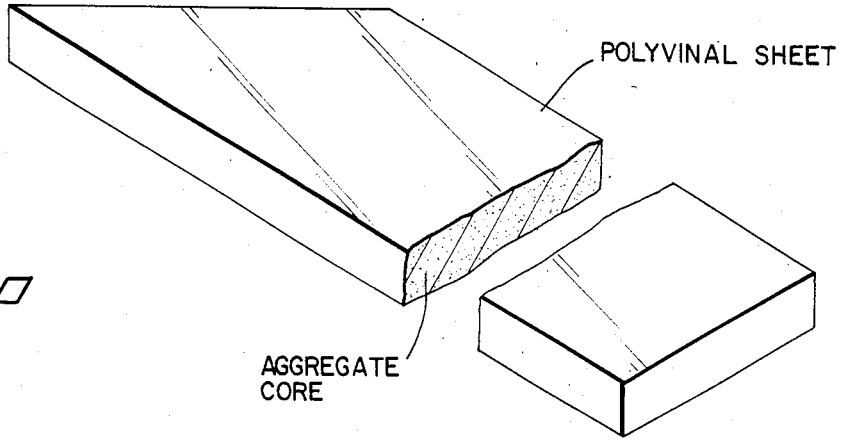
FIG. 10 is a perspective view, partly broken away, of a board panel constructed in accordance with the invention and designed for use either for an exterior wall finish or for closing in the roof truss.

Referring now in detail to FIG. 1 by numerals of reference, the initial step in practicing the invention is the selection of a suitable site 10 and the preparation of its surface. Generally, all that is needed is the usual preparation for pouring a slab. In practicing the present invention, however, a cage-like framework 12 is erected on the site surface. The framework is constructed from a plurality of transverse bottom pipe members 14, upright pipe members 16, and transverse pipe members 18, 20. Preferably, these are inexpensive, 1½" outer diameter black iron pipe. These pipes are coped and welded together so that the framework becomes unitary. The joints may be plastic-coated and sealed.

A roof truss 22 is disposed on top of the framework. A plurality of slats 24 are secured transversely across the different sections of the roof truss, for supporting panels to be applied later.

A 6" steel mesh (not shown) is disposed over the site surface within the boundaries defined by the bottom pipe members 14, and the ends of the mesh are welded to the bottom pipe members 14. A 4" concrete slab is then poured over site surface to enclose within the slab the steel mesh and the bottom pipe members 14.

Block panels are preformed as shown in FIGS. 2, 3 and 4. Each panel 26 has embedded therein a ⅛" by 6" mesh 28 and at least eight fastening straps 30. As shown in FIGS. 2 and 3, there are preferably at least two of these fastening straps 30 projecting from each side of each block panel 26, for securing the block panels in place by welding of the fastening straps 30 to adjacent pipe members of the framework.

Each of these preformed block panels 26 is formed with a peripheral flange 32 that is defined in part by a recessed or inwardly curved peripheral part 34. This curved part 34 is proportioned, as is best shown in FIG. 5, so that each block panel 26 will nest within one of the 4' by 4' wall openings or ceiling openings of the framework 12, with the curved part 34 confronting and engaged against the outer surface of one of the pipe members 16. The fastening straps 30 can be adjusted in position, as best shown in FIGS. 3 and 5, to permit welding to the pipe members so that each pipe member is embraced between one of the steel straps 30 and the flange portion 32 of the panel. The straps 30 may be made from eight-gauge steel.

The panel blocks 26 are preferably formed from lightweight aggregate material together with reinforcing filamentary material and a binder. In a preferred embodiment, the aggregate may be 1"–2" pumice admixed with 3" long nylon staple fiber, held together with a binder of animal glue, epoxy resin, and fire retardant.

To close in the framework shown in FIG. 1, a plurality of these block panels 26 are inserted in the wall and ceiling openings, respectively, and are welded in place. This provides a unitary structure of very high strength. When the block panels are prepared from the suggested materials, they are light in weight, have good insulating value, and are fire-resistant.

Figure 9:
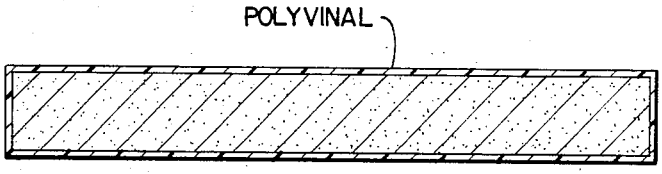
FIG. 9 is a section, in a vertical plane, of a board panel constructed in accordance with one embodiment of the invention, for use in covering the roof.

To close in the building, roof panels are secured on the slats 24. The sides of the roof truss 22 may be closed in similar fashion, using preformed and shaped board panels as shown, for example in FIGS. 9 and 10. According to a preferred embodiment of the invention, the board is preformed from ¼" pumice aggregate mixed with 2" long staple nylon filament, together with a binder of animal glue and epoxy resin containing a fire retardant. The boards are preferably about ½" thick, and may be preformed in desired dimensions and shapes as shown in FIGS. 9 and 10. Preferably, the board is encased in polyvinyl sheet. This same board may be bonded over the exterior surfaces of the block panels that are secured within the framework openings, for an attractive exterior finish to the dwelling, as shown in FIG. 7. Similarly, ½" gypsum board may be disposed over the interior surfaces of the block panels, preferably in such fashion as to cover and conceal any exposed pipes, again as shown in FIG. 7.

Alternatively, for the exterior finish, the board panels may be coated with synthetic finishes of rock-stone-brick or aggregate made from plastics, polyvinyl or polyester, that will withstand ultraviolet and infrared rays.

The plumbing is preferably installed from polyvinyl chloride pipe. Doors for the dwelling may be formed from a laminate of 1" thick block panel, covered with board panels of the kind illustrated in FIGS. 9 and 10, all of appropriate size, and all encased in plastic-covered steel channels and equipped with deadbolt locks. The windows may be ½" plastic-coated steel "T" frames, equipped with drop-locks and 6" by 8" panes. The frames for both doors and windows preferably are steel frames welded to the construction framing.

Homes constructed in accordance with the present invention have a great many advantages. Each dwelling unit is 100% framed with the steel or black iron framework shown in FIG. 1, with additional steel mesh reinforcement in the concrete slab floor and in the block panels that form the walls. This creates an extremely strong dwelling. The thick reinforced walls and roof guarantee maximum insulation and strength. The construction is compatible in appearance with any frame and veneer construction.

Other major advantages of the present invention are that construction can be simple and fast, and at low cost. The structure is so strong that it will resist high winds and earth tremors. The entire construction is fire-retardant and insect-(termite) proof. The materials employed will not rot or deteriorate with normal use. When the doors are sealed, the structure should be tight against flood waters.

Still another important advantage is that the cage-like framework eliminates the need for a deep wall foundation. Moreover, the materials employed in the preferred embodiment of the invention provide very good thermal insulation, which may be 38 R, roof, walls and ceiling.

Figure 11:
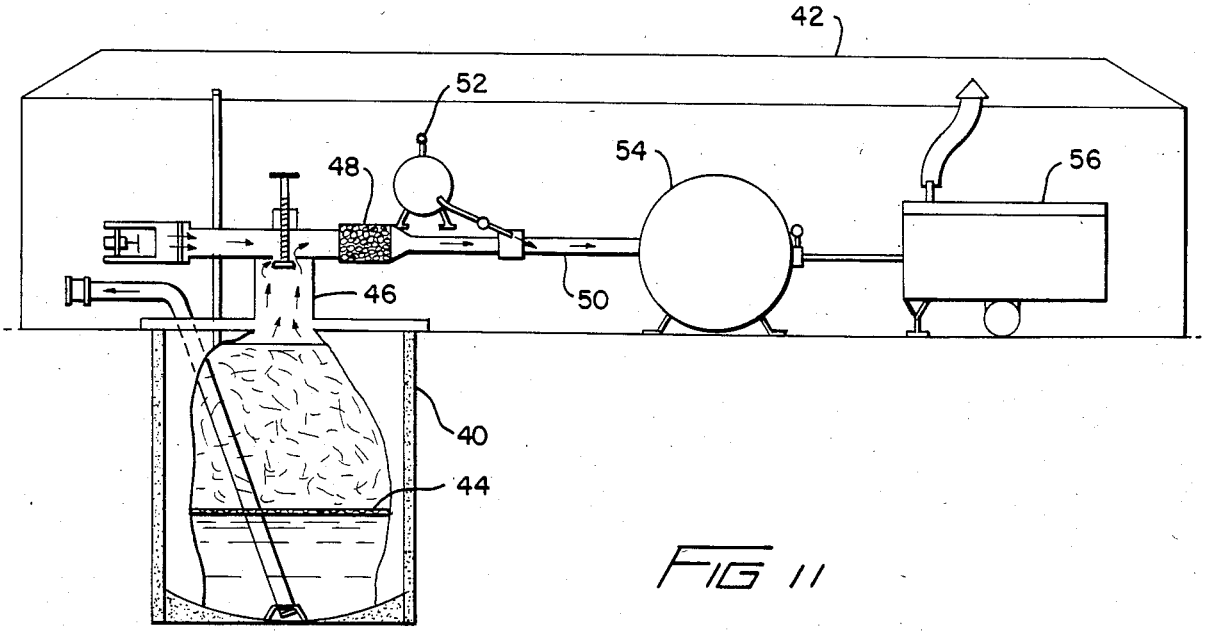
FIG. 11 is a schematic diagram of a sewage treatment system that could be used in conjunction wth the dwelling to recover useful energy values, in the form of gas, from household sewage.

For a subdivision made of dwelling units having the construction disclosed, it is a useful economy to have a self-contained system for disposing of waste while generating useful energy values. A schematic system for accomplishing this is shown in FIG. 11. A prestressed concrete septic tank 40 is disposed in the ground beneath a shed structure 42. Disposed within the septic tank 40 is a 1" plastic-coated mesh grill 44. This grill is formed with 1" apertures so that solids introduced into the prestressed concrete tank are supported on the grill 44 but liquid can seep through the grill to collect in the bottom of the prestressed concrete tank 40. Bacterial action within the tank 40 generates methane that can be collected through an overhead collection pipe 46 and passed through a filter 48, and thence into a feed pipe 50. If necessary, propane gas from a reservoir tank 52 may be fed into the line 50 to augment the fuel value of the methane gas. The line 50 is disposed to deliver the gas or gas mixture into a holding tank 54 for eventual use as needed. It may be used, for example, as a source of power for a generator 56.

I claim:

1. A process for constructing a building on a site comprising:

erecting on said site a welded cage-like framework fabricated from weldable pipe, said framework having bottom members for engagement with the surface of the site to support said framework thereon, said framework being formed with upright pipe members and with other transverse pipe members which, with said bottom transverse members, are interposed between said upright members, forming said framework therewith, said framework also having a welded metal roof truss carried thereon, said pipe members and said truss being united to each other by welding in a rigid, unitary, integral structure, said upright members and said transverse members being disposed to provide therebetween a plurality of wall and ceiling openings of predetermined sizes, securing in said wall openings block panels that nest snugly within said openings and that each have peripheral flanged parts that extend laterally about underlying parts of said framework, and that are proportioned so that the confronting flanged parts of adjacent panels are in abutting engagement with each other, and pouring a concrete slab on said site surface to form a floor for said building with said slab enclosing therein said bottom members and the lower ends of the upright members that are adjacent to and united with said bottom members.

2. The process of claim 1, comprising:

precasting said block panels with metal reinforcement therein and with metal projections disposed about the perimeter thereof, and securing said block panels in place within said framework openings by welding said metal projections to said framework members.

3. The process of claim 2, wherein said metal reinforcement is metal mesh.

4. The process of claim 3, wherein said metal projections are metal straps that are welded to said metal mesh.

5. The process of claim 1, comprising:

disposing over said site surface, prior to casting said floor, reinforcing metal means and welding said reinforcing metal means to said bottom members to unite them, then pouring said slab.

6. The process of claim 1, comprising securing precast board panels to said roof truss to form a roof to cover said building.

7. The process of claim 6, wherein said board panels are formed with projecting metal straps, and comprising the step of:

securing metal slats transversely of said roof truss, and then securing said panels in place by welding said straps to said slats.

8. The process of claim 1, comprising inserting block panels in said ceiling openings and securing them in place to said framework, to form a unitary structure of said ceiling panels and said framework.

9. A process for constructing a building on a site comprising:

erecting on said site a welded cage-like framework that is fabricated from coped black iron pipe, said framework having bottom transverse pipe members for engagement with the surface of the site to support said framework thereon, said framework being formed with upright pipe members and with other transverse pipe members which, with said bottom transverse pipe members, are interposed between said upright members, forming said framework therewith, said framework also having a welded metal roof truss carried thereon, said members and said truss being united to each other by welding in a unitary, rigid, integral structure, said upright pipe members and said transverse pipe members being disposed to provide a plurality of wall and ceiling openings of predetermined sizes, inserting nestable block panels into said wall and ceiling openings, said panels having metal mesh reinforcement therein and metal projections therefrom that are unitary with said reinforcement and disposed to project laterally from the perimeter thereof, securing said block panels in place with said framework openings by welding said metal projections to said framework pipe members, disposing over said site surface reinforcing metal mesh, and welding said reinforcing metal mesh to said bottom pipe members to unit them, pouring a concrete slab on each site surface to form a floor for said building, with said slab enclosing therein said metal mesh and bottom pipe members and the lower ends of those upright members that are adjacent to and united with said bottom members, and securing board panels to said roof truss to form a roof to cover said building.

10. The building construction of claim 1 wherein the pipe members comprise coped black iron.

11. A building construction for a site having a surface comprising:

a cage-like framework that is fabricated from weldable pipe, said framework having bottom transverse pipe members engaging the surface of the site to support said framework, said framework being formed with upright pipe members and with other transverse pipe members which, with said bottom transverse members, are interposed between said upright pipe members forming said framework therewith, said framework also having a welded metal roof truss carried thereon, said pipe members and said truss being united to each other by welding in a unitary, rigid, integral structure, said upright members and said transverse members being disposed to provide a plurality of wall and ceiling openings of predetermined sizes, block panels secured in said wall openings and nesting snugly within said openings, each said block panel having a peripheral flange that extends about underlying parts of said framework, said block panels being proportioned so that the confronting flanges of adjacent panels are in abutting engagement with each other, whereby said panels form a generally continuous external surface for said framework, where applied, a concrete slab cast on said site surface forming a floor for said building, said slab enclosing therein said bottom pipe members and the lower ends of those members that are adjacent to and united with said bottom members, and board panels disposed over said roof truss to form a roof to cover said building.

12. The building construction of claim 11, wherein said block panels are formed with projecting metal straps, and said straps are welded to adjacent pipe members to form a unitary structure.

13. The building construction of claim 11, wherein said block panels are precast with metal reinforcement therein and with metal projections disposed about the perimeters thereof, said block panels being secured in place within said wall openings of said framework by said metal projections being welded to said framework pipe members.

14. The building construction of claim 13, wherein said metal reinforcement comprises metal mesh.

15. The building construction of claim 11, wherein said concrete slab is reinforced with reinforcing metal means welded to said bottom pipe members.

16. The building construction of claim 15, comprising:

block panels inserted in said ceiling openings in said cage framework.

17. The building construction of claim 16, comprising:

metal slats disposed on and secured to said roof truss, and board panels that are formed with projecting metal straps secured over said roof truss by welding of said straps to said slats.

18. The building construction of claim 11 wherein the pipe members comprise coped black iron.

* * * * *